United States Patent [19]

Aileo

[11] 3,943,572

[45] Mar. 16, 1976

[54] HELMET RETENTION SYSTEM

[75] Inventor: Jackson A. Aileo, Carbondale, Pa.

[73] Assignee: Gentex Corporation, Carbondale, Pa.

[22] Filed: June 10, 1974

[21] Appl. No.: 477,785

[52] U.S. Cl. ..... 2/3 R; 2/209; 179/156 R

[51] Int. Cl.[2] ..... A42B 1/24; A42B 3/00

[58] Field of Search ..... 2/6, 3 R, 209; 179/156 R

[56] References Cited

UNITED STATES PATENTS

| | | | |
|---|---|---|---|
| 1,463,810 | 8/1923 | Gilson | 179/156 R |
| 3,423,759 | 1/1969 | Catroppa et al. | 2/6 |
| 3,447,162 | 6/1969 | Aileo | 2/3 R |
| 3,456,263 | 7/1969 | Aileo | 2/3 R |

FOREIGN PATENTS OR APPLICATIONS

| | | | |
|---|---|---|---|
| 308,737 | 10/1918 | Germany | 2/6 |
| 1,005,187 | 9/1965 | United Kingdom | 2/6 |

*Primary Examiner*—Werner H. Schroeder
*Assistant Examiner*—Peter Nerbun
*Attorney, Agent, or Firm*—Shenier & O'Connor

[57] ABSTRACT

A protective helmet having a rigid shell with a headband and crown suspension system and provided with readily adjustable sound-attenuating earcup assemblies, in which right and left hand flexible fabric earcup assembly supports are secured at locations adjacent to the upper ends thereof to the rigid shell for movement of the earcup assemblies carried thereby toward and away from the wearer's head, and in which an adjustable chin strap assembly, the ends of which are anchored to the rigid shell at locations below the points of attachment of the earcup supports to the shell, carries respective fastener elements adapted releasably to be engaged with fastener elements adjacent to the lower ends of the cup supports so that, when the chin strap is pulled to draw the helmet down firmly to engage the suspension with the wearer's head, the earcup assemblies are moved toward the wearer's head to cause the seals thereof firmly to engage the portions of the wearer's head around his ears. One or more pads of energy absorbing material are readily detachably and reattachably secured to the outer surface of the earcup supports and to the portion of the headband at the back of the wearer's head.

27 Claims, 6 Drawing Figures

HELMET RETENTION SYSTEM

BACKGROUND OF THE INVENTION

There are known in the prior art protective helmets comprising rigid shells and suspensions for supporting the shell on the wearer's head. There are further known in the prior art sound-attenuating earcup assemblies which are provided with seals adapted to engage the surface of the wearer's head around his ears. In many applications it is desirable that a protective helmet be provided with sound-attenuating earcup assemblies. My prior U.S. Pat. No. 3,456,263 dislcoses an arrangement in which a rigid shell helmet is provided with sound-attenuating earcup assemblies. In the arrangement shown in that patent, the earcup assemblies are mounted in the ear portions of the rigid shell. Spacers are provided between the shell and the earcup assembly for positioning the assembly at a location at which it can engage the wearer's head around his ear when the helmet is donned. More particularly, in the arrangement shown in my prior patent the outermost of the spacer pads os permaently adhered to the inner surface of the rigid shell by an adhesive or the like.

While the arrangement shown in my prior patent referred to hereinabove successfully combines sound-attenuating earcup assemblies with a rigid shell, the helmet is not as convenient to use as is desirable. Some difficulty is experienced in donning the helmet without disturbing the orientation of the earcup assemblies. The individual earcup assemblies must be manipulated properly to position them after the helmet has been donned. The arrangement may not always provide as effective a seal as is desirable between the earcup assembly and the wearer's head. In addition, owing to the fact that at least the outermost of the spacer pads is permanently adhered to the rigid shell, it cannot readily be removed for cleaning or replacement.

I have invented an improved helmet retention system which overcomes the disadvantages of retention systems of the prior art. My helmet retention system successfully combines sound-attenuating earcups with a rigid helmet. My helmet retention assembly insures that optimum use is made of the sound-attenuating properties of the sound-attenuating earcup assemblies. It does not require any adjustment of the earcup assemblies after the helmet is donned. My retention assembly permits the helmet to be donned in a rapid and expeditious manner. The construction of my helmet retention system faclitates the removal and replacement of shock absorbing elements.

SUMMARY OF THE INVENTION

One object of my invention is to provide a helmet retention system which overcomes the deficiencies of retention systems of the prior art.

Another object of my invention is to provide a helmet retention system which successfully combines the properties of sound-attenuating earcup assemblies with those of a rigid helmet structure.

Another object of my invention is to provide a helmet retention assembly which permits of optimum use of the sound-attenuating properties of sound-attenuating earcup assemblies.

Still another object of my invention is to provide a helmet retention assembly which permits the helmet to be donned with relative ease.

Yet another object of my invention is to provide a helmet retention assembly which does not require manipulation of sound-attenuating earcup assemblies after the helmet has been donned.

A still further object of my invention is to provide a helmet retention system which facilitates removal and replacement of energy-absorbing pads.

Other and further objects of my invention will appear from the following description.

In general my invention contemplates the provision of a helmet retention assembly for a helmet including a rigid outer shell in which a pair of flexible fabric earcup assembly supporting members are secured at the upper ends thereof to the rigid shell to permit sound-attenuating earcup assemblies carried thereby to move toward and away from the wearer's head. I provide a chin strap, the ends of which are anchored to the rigid shell at locations below the points of attachment of the earcup assembly supports with respective fastener elements adapted to releasably engage fastener elements adjacent to the lower ends of the earcup assembly supports so that, when the chin strap is tightened to draw the helmet and its suspension down onto the wearer's head, at the same time the flexible earcup assembly supports are moved inwardly to cause the seals on the sound-attenuating earcup assemblies firmly to engage the surface of the wearer's head around his ears. I readily detachably adn reattachably secure shock absorbing pads to the outer surfaces of the earcup assembly supports and to the portion of the suspension headband at the back of the wearer's head.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
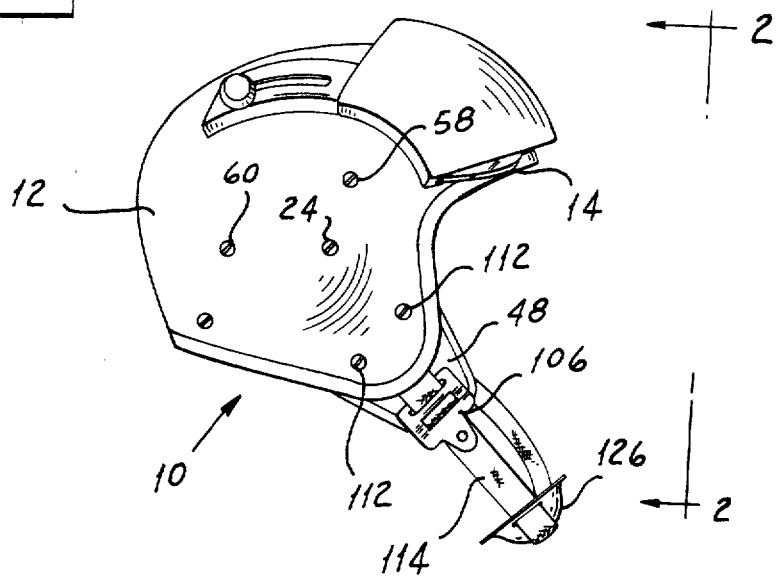
FIG. 1 is a side elevation of a rigid shell helmet provided with my helmet retention system.
Figure 2:
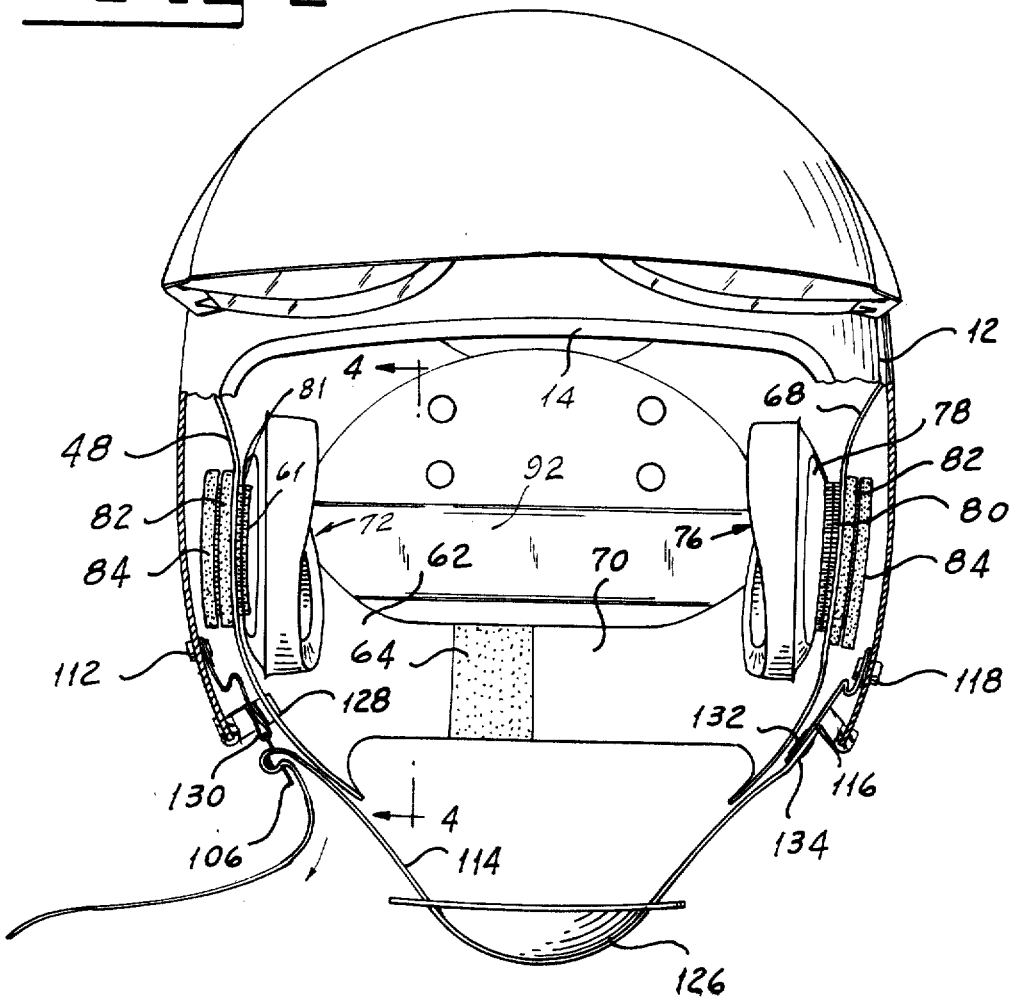
FIG. 2 is a front elevation of the helmet shown in FIG. 1 with parts broken away and with other parts shown in section.
Figure 3:
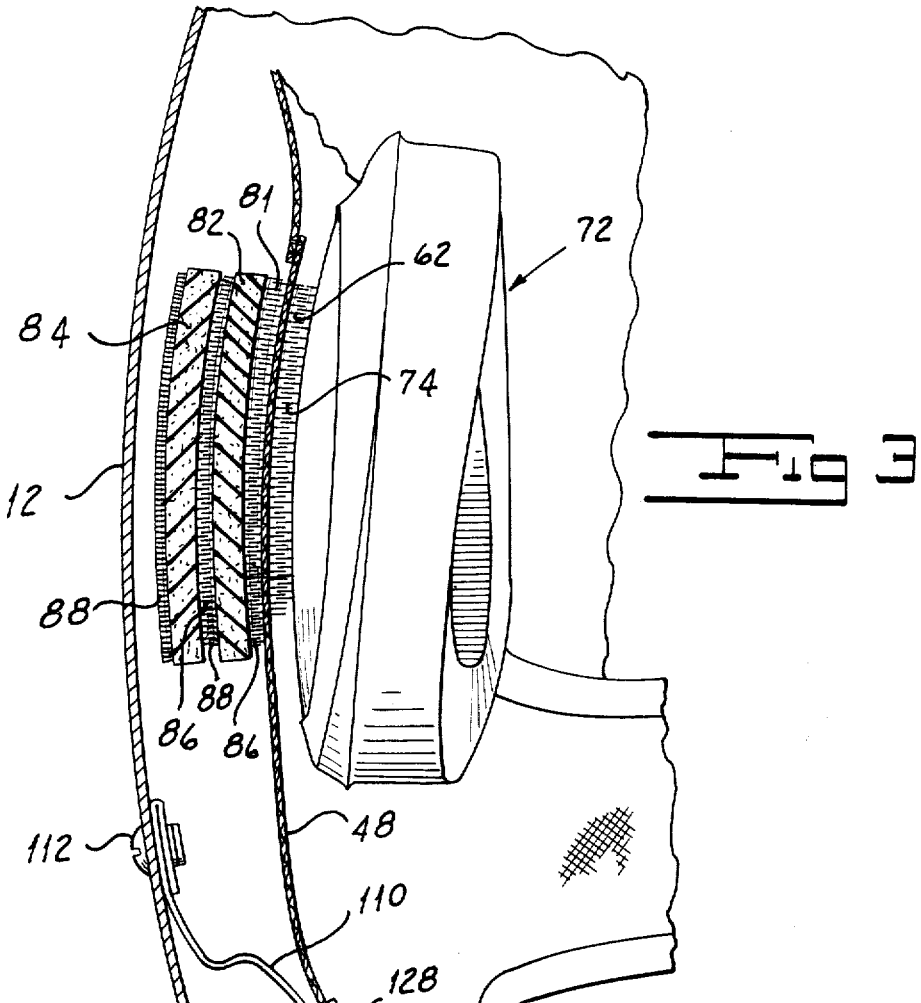
FIG. 3 is a fragmentary sectional view of a helmet provided with my helmet retention system.

Referring now to the drawings, a helmet indicated generally by the reference character 10, which may be provided with my helmet retention system, includes a hard outer shell 12 formed from any suitable rigid material. The periphery of the shell 12 is provided with an edging 14 made from any suitable relatively soft material, such, for example, as natural or synthetic rubber, adhered to the shell. I provide the shell 12 with a liner 16 of impact resistant material such, for example, as foamed synthetic resin extending over the crown, forehead and back portions of the shell and cut out as required to attach other parts of the assembly in a manner to be described. Preferably I adhere, or otherwise secure, a foam rubber liner 18 over the inner surface of the impact resistant layer 16.

The helmet 10 inculdes a pair of suspension headband fittings 20 and 22 attached to the shell 12 by an suitable means, such, for example, as by bolts 24. The headband includes a front headband half 26 threaded back and forth through openings in the fittings 20 and 22 and stitched to itself to form the front portion of the headband. Similarly, I provide a rear headband half 28 made up of a length of webbing or the like, threaded back and forth through the fittings 20 and 22 and stitched to itself to form the rear headband half. I provide the headband halves 26 and 28 with respective head engaging perforated pads 30 and 32.

The suspension includes a pair of crossed crown straps 34 and 36 extending diagonally across the wearer's head and passing through sutiable slots in a crown pad 38 which may, for example, be formed from a piece of foam rubber covered with leather or a leather-like material. A fore-and-aft crown strap 40 extends over the crown pad 38, but is not attached thereto. I provide means for attaching the ends of the straps 34, 36 and 40 and the front and rear headband halves 26 and 28 to the shell 12. Since all of these arrangements are substantially the same, I will describe in detail only that arrangement which is used to secure the back end of the fore-and-aft strap 40 and one point on the rear headband half 28 to the shell 12.

Figure 5:
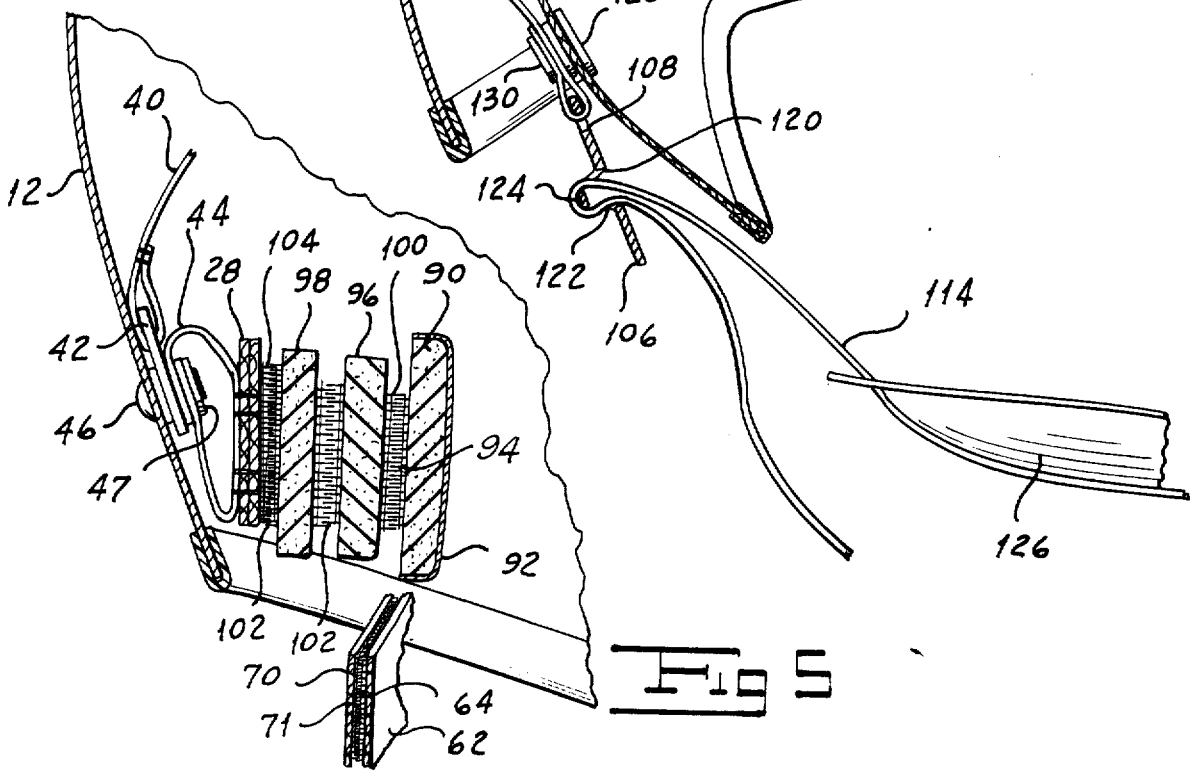
FIG. 5 is a fragmentary sectional view of the back of the helmet illustrated in FIG. 1.
Figure 4:
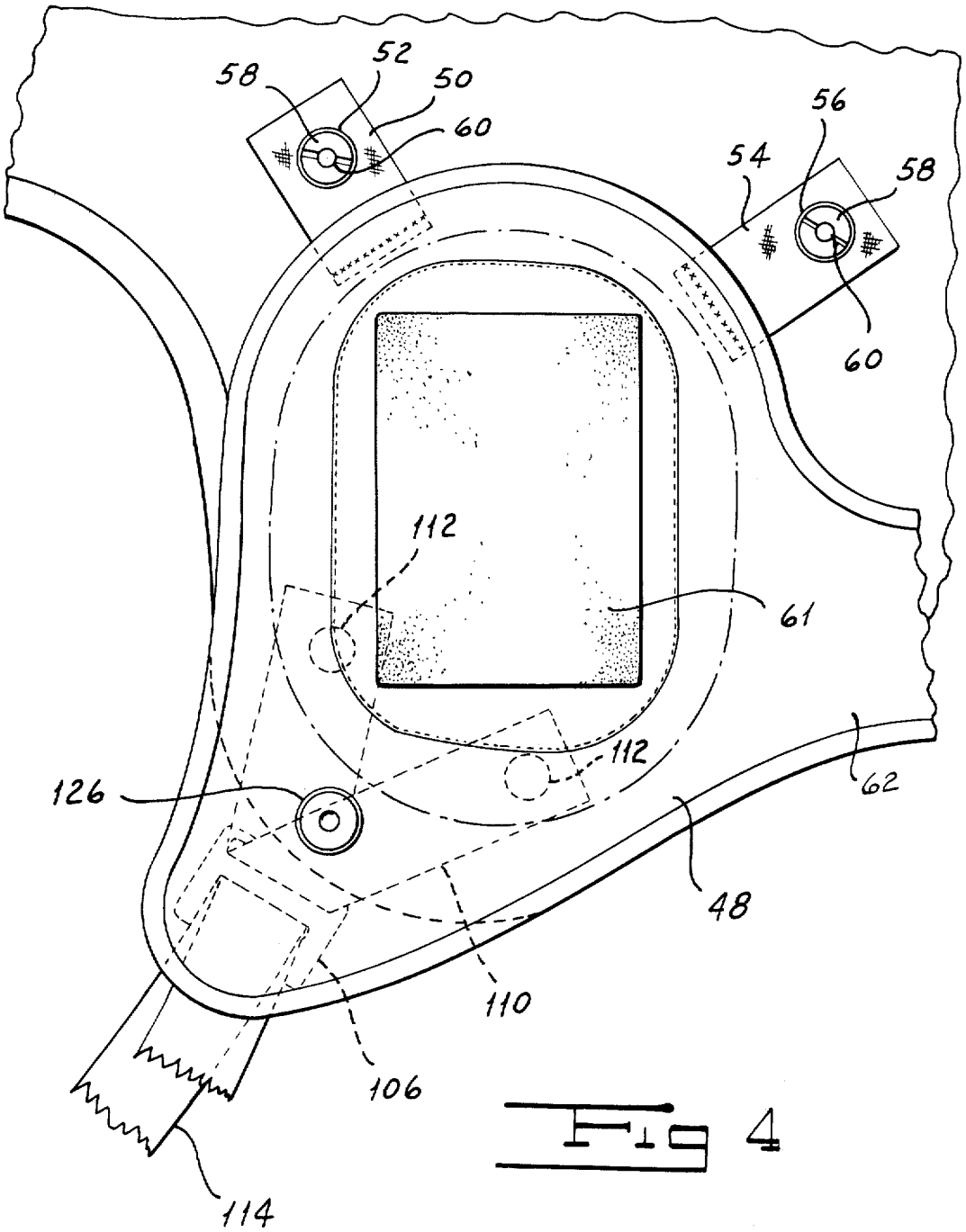
FIG. 4 is a fragmentary view of the helmet illustrated in FIG. 1, showing the right hand earcup support viewed from the inside of the helmet.
Figure 6:
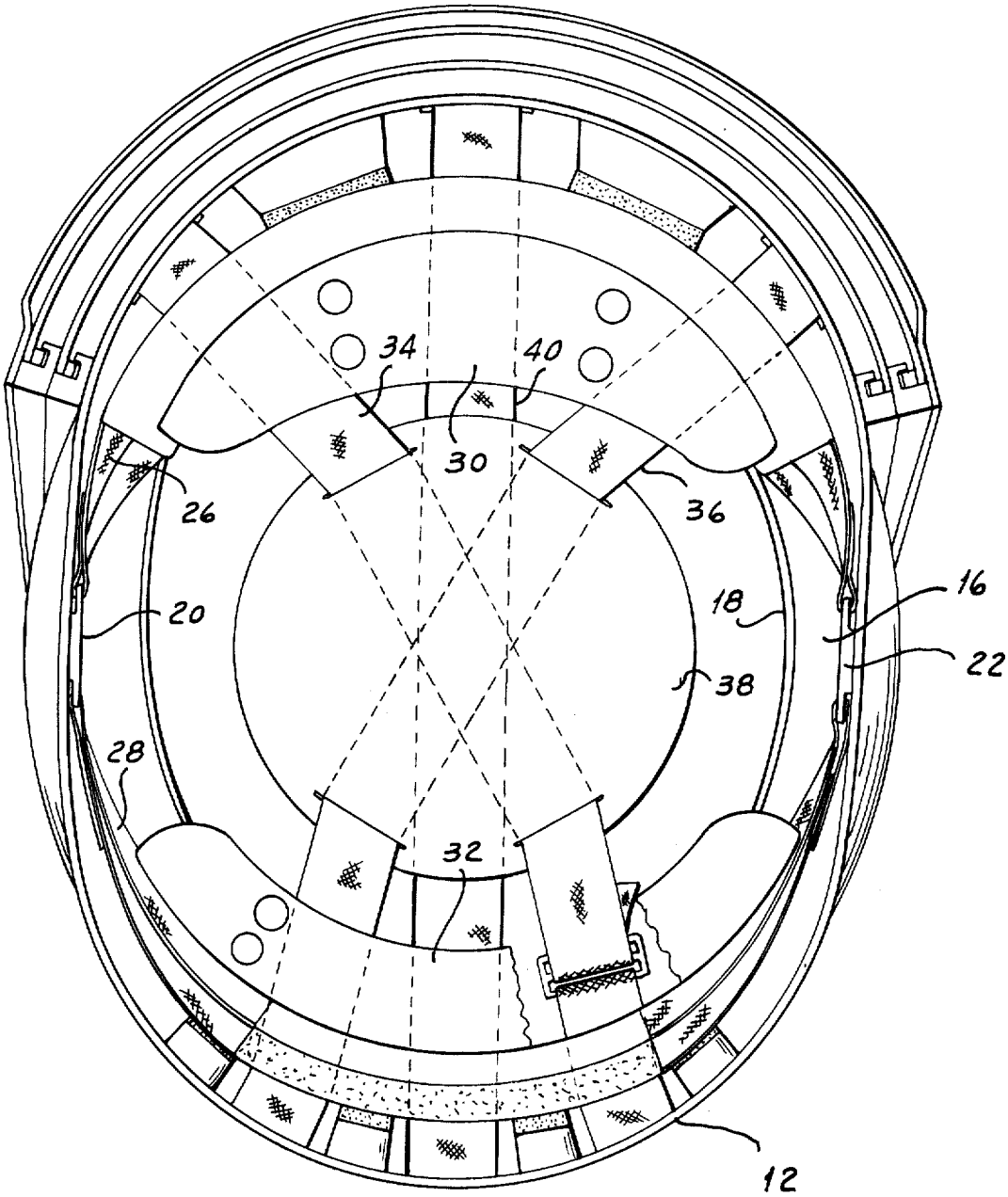
FIG. 6 is a plan view of the helmet shown in FIG. 1 from the bottom thereof with the earcup supports and chin strap removed for purposes of exposition.

Referring now to FIG. 5, a fitting 42 at the rear of the helmet is provided with a slot through which I thread the band 40 and then secure it to itself by stitching. I attach a loop 44 of webbing to the rear headband half 28. A bolt 46, which passes through the shell 12 and through a hole in fitting 42, passes through the ends of the loop 44 of fabric stitched to the headband. A plate-like element 47 receives the threaded shank of the bolt 46 to hold loop 44 and the fitting 42 to the shell 12.

Referring now to FIGS. 2 to 5, my retention system includes a right hand earcup support 48 formed from a suitable flexible material sch as a woven fabric. A first webbing length 50, stitched or otherwise secured to the support 48 adjacent to the top front thereof and extending generally upwardly and forwardly, carries a grommet 52. A second fabric length 54, secured to the support 48 adjacent to the top rear thereof and extending generally upwardly and rearwardly, carries a grommet 56. Each of the grommets 52 and 56 receives a nut 58 adapted to cooperate with a bolt 60 for attaching the lengths 50 and 54 to the hard shell 12. I provide the support 48 with a fastener piece 61 secured thereto by stitching or the like. The piece 61 is made up of elements comprising one-half of a readily releasable and reattachable fastening means, which half may comprise a plurality of tiny loops of synthetic resin which are adapted to cooperate with another piece, to be described, made up of a plurality of small hooks of synthetic resin. Fasteners of this type are made and sold by The American Velcro Company under the registered trademark "Velcro". A rearwardly directed extension 62 on the support 48 forms one-half of a nape strap. This extension 62 carries a Velcro fastener piece 64.

My retention system includes a left hand earcup support 68 formed of the same material and of the same general configuration as is the right hand earcup support 48. I provide the support 68 with a rearward extension 70 forming the other half of the nape strap and carrying a Velcro fastener piece 71 which is complementary to the fastener piece 64. A right hand sound-attenuating earcup assembly indicated generally by the reference character 72 carries a Velcro fastener piece 74 adapted to cooperate with the piece 62 on the right hand earcup support 48 releasably to hold the assembly 72 in position on the support. It will readily be appreciated that the cooperating fastener pieces 62 and 74 permit the position and orientation of the assembly 72 to be changed with relative ease. A left hand earcup assembly indicated generally by the reference character 76 carries a Velcro piece 78 adapted to cooperate with a complementary Velcro fastener piece 80 secured to the inner surface of the left hand earcup assembly support 68. Preferably, the earcup assemblies 72 and 76 are of the type shown and described in my co-pending Application Ser. No. 322,525, filed Jan. 10, 1973, for "Sound Attenuating Earcup", now U.S. Pat. No. 3,875,592.

I provide the support 48 with an outer Velcro fastener piece 81. A pair of right hand pads 82 and 84 formed from any suitable energy absorbing material such, for example, as natural or synthetic foam rubber, carry inner and outer Velcro fastener pieces 86 and 88, which are complementary to each other. The inner Velcro piece 86 of the pad 82 is arranged to be complementary to the outer Velcro piece 81 on the support 48. In this manner two or more of the shock absorbing pads 80 and 82 can be attached together and can be attached to the support 48. At the same time they may readily be removed from the support and from each other to permit replacement, if desired. I employ the same shock absorbing arrangement for the left hand support 68.

Referring again to FIG. 5, my helmet retention assembly includes an innermost rear shock absorbing pad 90 provided with a leather cover 92 adapted to engage the back of the wearer's head. The outer surface of the pad 90 carries a Velcro fastener piece 94. I provide two additional rear shock absorbing pads 96 and 98. The inner surface of each of the pads 96 and 98 carries a Velcro fastener piece 100 which is complementary to the fastener piece 94. Respective outer fastener pieces 102 on the pads 96 and 98 may be of the same kind as is the piece 94. A Velcro fastener piece 104 complementary to the piece 102 is secured to the rear headband half 28 to permit the assembly of the energy absorbing pads 90, 96 and 98 to be secured to the rear headband half 28.

My helmet retention system includes a chin strap buckle 106 provided with a first slot 108 through which a length 110 of webbing passes and is stitched to itself to form a vee. Any suitable means such, as for example, bolts 112 are employed to secure the ends of the webbing vee to the rigid outer shell 12. The chin strap proper 114 has a fabric vee 116 stitched thereto at one end thereof. The ends of the vee 116 are secured to the hard outer shell by any suitable means such as by bolts 118. The free end of the strap 114 passes through an intermediate slot 120 in the buckle 106 over a snub 124 and back through another slot 122 in the buckle 106. Strap 114 carries a chin cup 126 formed from leather or the like adapted to engage the chin of the wearer when the strap is pulled tight.

A male snap fastener element 128 carried by the support 48 is adapted to engage a female snap fastener element 130 carried by the fabric vee 110 to connect the support 48 to the chin strap assembly. Another male snap fastener element 132 carried by the earcup support 68 adjacent to the lower end thereof is adapted to be snapped into engagement with a female snap fastener element 134 carried by the fabric vee 116, thus to connect the support 68 to the chin strap assembly.

In use of my helmet retention system and the helmet 10 with which it is associated, a number of the energy-absorbing pads 82 and 84 are assembled on the outer surfaces of the two earcup assembly supports 48 and 68. Next, the two earcup assemblies 72 and 76 are applied to the two inner surfaces, and their relative positions and orientations may be adjusted as desired. As many of the rear energy-absorbing pads 90, 96, and 98 as are necessary or desirable may be assembled on the back headband portion 28. The fastener elementss 128 and 130 and 132 and 134 are engaged.

When the above operations have been performed, the helmet is ready to be donned. After the helmet has been donned, the chin strap 114 is pulled in a direction to draw it tight to bring the chin cup 126 into engagement with the wearer's chin. In the course of this operation, owing to the connection between the chin strap 114 and the lower portions of the two earcup assembly supports 48 and 68, the earcup assemblies 72 and 76 will be drawn toward the wearer's head to permit the sealing pads thereof firmly to engage the wearer's head around his ears. When it is desired to remove the helmet, the lower end of the buckle 106 is moved away from the chin strap 114 to release the strap to permit it to be drawn out of the buckle so that the helmet can be removed. If for any reason it becomes necessary or desirable to remove any of the shock absorbing pads 82, 84, 90, 96 and 98, this can readily be done and the pads may readily be replaced.

It will be seen that I have accomplished the objects of my invention. I have provided a helmmet retention system for a rigid shell helmet provided with sound-attenuating earcups which overcomes the disadvantages of rigid helmets provided with earcups of the prior art. My helmet retention assembly permits the helmet to be drawn firmly down onto the wearer's head and the earcups to be brought into sealing engagement with the wearer's head around his ears in a single simple operation. My retention assembly thus makes optimum use of the sound-attenuating properties of the earcup assemblies. The shock absorbing ear pads and rear head pads may readily be removed and replaced with ease.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A helmet assembly including in combination, a rigid outer shell, respective left hand and right hand earcup assembly supports of flexible material, respective earcup assemblies carried by said supports, means for securing said supports adjacent to the upper ends thereof to said rigid outer shell at first locations thereon for movement of said earcup assemblies toward and away from the wearer's head, an adjustable chinstrap assembly, means for securing the ends of said chinstrap assembly to said rigid outer shell at second locations thereon below said first locations and means for connecting said chinstrap assembly at spaced locations intermediate the ends thereof to said earcup assembly supports adjacent to the lower ends thereof to move said earcup assemblies toward the wearer's head as said chinstrap assembly is actuated to hold said shell on the wearer's head.

2. A helmet assembly as in claim 1 including means for manually detachably mounting said earcup assemblies on said supports.

3. A helmet assembly as in claim 2 in which said mounting means permits of adjustment of the position and angular orientation of said earcup assemblies on said support.

4. A helmet assembly as in claim 1 in which said rigid shell comprises left and right ear portions, said earcup assembly support securing means being located above said rigid shell ear portions, and in which said chinstrap assembly securing means are located adjacent to the lower ends of said rigid shell ear portions.

5. A helmet assembly as in claim 4 in which said interconnecting means are located relatively adjacent to the ends of said chinstrap assembly.

6. A helmet assembly as in claim 5 in which said chinstrap assembly includes strap length adjusting means disposed between said interconnecting means.

7. A helmet assembly as in claim 6 in which said interconnecting means are manually releasable.

8. A helmet assembly as in claim 7 in which said length adjusting means comprises a free strap end and a buckle for receiving said free strap end.

9. A helmet assembly as in claim 1 in which said interconnecting means are located relatively adjacent to the ends of said chinstrap assembly.

10. A helmet assembly as in claim 1 in which said interconnecting means are manually engageable and disengageable.

11. A helmet assembly as in claim 1 in which said interconnecting means are snap fasteners.

12. A helmet assembly as in claim 1 including a pad of energy absorbing material disposed between one of said supports and said shell and means mounting said pad on said support.

13. A helmet assembly as in claim 12 in which said pad mounting means is readily manually detachable and reattachable.

14. A helmet assembly as in claim 1 including respective pads of energy absorbing material disposed between said supports and said shell and means mounting said pads on said supports.

15. A helmet assembly as in claim 14 in which said mounting means is readily manually attachable and detachable.

16. A helmet assembly as in claim 1 including a plurality of pads of impact absorbing material disposed between each of said supports and said shell, means for readily manually assembling and disassembling the pads of said plurality into two stacks, and manually operable means for releasably securing said stacks respectively to said supports.

17. A helmet assembly as in claim 1 including a headband secured to said shell, a pad of energy absorbing material and manually operable means for detachably mounting said pad of energy absorbing material on said headband adjacent to the back of the wearer's head.

18. A helmet assembly as in claim 1 including a headband secured to said shell, a plurality of back pads of energy absorbing material, manually operable means for assembling and disassembling the pads of said plurality into a stack and manually operable means for releasably securing said stack to the inner surface of said headband.

19. A helmet assembly including in combination, a rigid shell having right and left portions adapted to overlie the ears of a wearer, a pair of earcup assembly supports of flexible material, respective earcup assemblies carried by said supports, means for securing the upper ends of said supports to said shell at respective locations above the right and left portions of said shell for movement of the assemblies carried thereby toward and away from the wearer's head, a chinstrap assembly having length adjusting means intermediate its ends, means for securing the respective chinstrap assembly ends to said rigid shell at locations lying relatively in the lower parts of said right and left shell portions, and respective means connecting said chinstrap assemblly at points between its ends and said length adjusting means to said earcup assembly supports adjacent to the lower ends thereof so that upon actuation of said length adjusting means to shorten said chinstrap assembly said earcup assemblies are moved into engagement with the wearer's head around his ears.

20. A helmet assembly as in claim 19 in which said connecting means are readily manually engageable and disengageable.

21. A helmet assembly as in claim 19 including respective pads of energy absorbing material disposed between said earcup assembly supports and said shell portions and manually operable means for releasably attaching said pads to said supports.

22. A helmet assembly as in claim 19 including a plurality of pads of energy absorbing material disposed between each of said supports and its associated shell portion, manually operable means for releasably connecting said pads to form stacks thereof and manually operable means for detachably attaching said stacks respectively to said supports.

23. A helmet assembly as in claim 19 including a headband carried by said shell, a back pad of energy absorbing material and manually operable means for detachably assembling said back pad on said headband at a location at which it is adapted to engage the wearer's head.

24. A helmet assembly as in claim 19 including a plurality of back pads, manually operable means for detachably connecting said back pads to form a stack and manually operable means for detachably connecting said stack to said headband at a location to engage the back of the wearer's head.

25. A helmet assembly as in claim 19 including a plurality of side pads of energy absorbing material, manually operable means for detachably connecting the pads of said plurality to form two stacks of said side pads, manually operable means for detachably connecting said stacks respectively to said supports between the supports and the shell portions, a headband carried by said shell, a plurality of back pads of energy absorbing material, manually operable means for detachably connecting said back pads to form a stack and manually operable means for detachably securing said stack of back pads to said headband at a location to engage the back of the wearer's head.

26. A helmet assembly as in claim 25 including nape extensions on said supports and manually operable means for adjustably and releasably connecting said extensions.

27. A helmet assembly as in claim 19 including nape extensions on said supports and manually operable means for adjustably and releasably connecting said extensions.

* * * * *